United States Patent [19]

Hiramatsu

[11] 4,332,293

[45] Jun. 1, 1982

[54] CORRUGATED FIN TYPE HEAT EXCHANGER

[75] Inventor: Michio Hiramatsu, Kariya, Japan

[73] Assignee: Nippondenso Co., Ltd., Kariya, Japan

[21] Appl. No.: 154,458

[22] Filed: May 29, 1980

[30] Foreign Application Priority Data

Apr. 30, 1980 [JP] Japan ..... 55-58385

[51] Int. Cl.[3] ..... F28F 1/22

[52] U.S. Cl. ..... 165/153

[58] Field of Search ..... 165/152, 153

[56] References Cited

U.S. PATENT DOCUMENTS

| | | | |
|---|---|---|---|
| 2,573,161 | 10/1951 | Tadewald | 165/153 |
| 3,250,325 | 5/1966 | Rhodes et al. | 165/153 |
| 3,265,126 | 8/1966 | Donaldson | 165/153 |
| 3,993,125 | 11/1976 | Rhodes | 165/153 |

FOREIGN PATENT DOCUMENTS

| | | | |
|---|---|---|---|
| 123954 | 4/1947 | Australia | 165/152 |
| 2158505 | 5/1972 | Fed. Rep. of Germany | 165/153 |
| 47-4228 | 2/1972 | Japan | 165/153 |

*Primary Examiner*—Sheldon J. Richter

*Attorney, Agent, or Firm*—Cushman, Darby & Cushman

[57] ABSTRACT

A heat exchanger has a heat exchanger core comprising a single row of parallel tubes defining therein first series of passages for a first fluid and corrugated fins disposed between and thermally connected to each adjacent pair of tubes to cooperate therewith to define a second series of passages for a second fluid. Each tube is of a generally rectangular cross-section and arranged such that the longitudinal axis of the rectangular cross-section is parallel to the direction on the flow of the second fluid through the heat exchanger. The dimension of each fin as measured in the direction of the flow of the second fluid is within the range of from 12 to 23 mm, the pitch of the corrugated fins is within the range of from 1.5 to 3.3 mm and the dimension of the longitudinal axis of the rectangular cross-section of each tube is not greater than the dimension of each fin as measured in the direction of the flow of the second fluid.

23 Claims, 15 Drawing Figures

CORRUGATED FIN TYPE HEAT EXCHANGER

BACKGROUND OF THE INVENTION

1. Field of the Invention

The present invention relates to a corrugated fin type heat exchanger suitable for use, but not restrictively, as an automotive radiator, a heater core of an automotive heating system or the like.

2. Description of the Prior Art

In the conventional corrugated fin type heat exchanger for use as an automotive radiator, for example, tubes of substantially rectangular cross-section are arranged in two or three rows in the direction of the flow of air passing through the heat exchanger so that the resistance of the tubes to the flow of the engine cooling water is minimized. The tubes are arranged such that the longitudinal axis of the substantially rectangular cross-section of each tube extends substantially parallel to the flow of air through the heat exchanger to minimize the resistance of the heat exchanger to the air flow therethrough. Because of the two or three rows of the tube arrangement, each of the corrugated fins has a dimension or width of as large as 32 mm as measured in the direction of the flow of the air through the heat exchanger. The pitch of each corrugated fin is also as large as from 3.5 to 4 mm.

The automotive component parts disposed in the engine compartment of motor cars have been increased in number so as to comply with the recent automotive emission control regulations, with a result that the space within the engine compartment available for the installation of a radiator is extremely limited. In addition, it is considered very important to reduce the weights of respective automotive component parts so as to improve the fuel consumption rate of automobiles.

SUMMARY OF THE INVENTION

It is an object of the present invention to provide an improved corrugated fin type heat exchanger which can be used as an automotive radiator and which is compact but provides an improved heat exchange performance.

The heat exchanger according to the present invention comprises a plurality of parallel tubes defining therein a first series of passages for a first fluid and corrugated fins disposed between and thermally connected to each adjacent pair of tubes to cooperate therewith to define a second series of passages for a second fluid, each tube being of a substantially rectangular cross-section and arranged such that the longitudinal axis of the rectangular cross-section is substantially parallel to the direction of the flow of said second fluid passing through said second series of passages; means defining therein an inlet chamber for said first fluid and being operative to distribute said first fluid to said tubes; and means defining therein an outlet chamber and being operative to gather flows of said first fluid through said tubes, wherein:

the dimension of each of the corrugated fins as measured in the direction of the flow of said second fluid is within the range of from 12 to 23 mm;

the pitch of the corrugation of the corrugated fins is within the range of from 1.5 to 3.3 mm; and the dimension of the longitudinal axis of the rectangular cross-section of each tube is not greater than the dimension of each fin as measured in the direction of the flow of said second fluid, and wherein said tubes are arranged in a single row.

The dimension of each fin as measured in the direction of the flow of the second fluid may preferably be within the range of from 15 to 18 mm.

The pitch of the corrugation of the corrugated fins may preferably be within the range of from 1.8 to 2.8 mm.

The corrugated fins may preferably extend beyond the opposite ends of the rectangular cross-section of each associated tube a distance of up to 2 mm.

The pitch of the parallel tubes may preferably be within the range of from 8.5 to 14 mm and, more preferably, from 9 to 11 mm.

The corrugated fins may preferably be louvered to provide vanes and openings. Each louver vane may preferably have a width of from 0.7 to 1.2 mm. More preferably, the louver vane width may be within the range of from 0.9 to 1.1 mm. Each louver vane may preferably be inclined to the general plane of an associated fin at an angle of from 24° to 28°. More preferably, the angle of inclination of each louver vane to the general plane of the associated fin may be substantially 25°.

The heat exchanger having the features set forth above may preferably be used, but not restrictively, as an automotive radiator.

The above and other objects, features and advantages of the present invention will be made more apparent by the following description with reference to the accompanying drawings.

DESCRIPTION OF PREFERRED EMBODIMENTS

Figure 1:
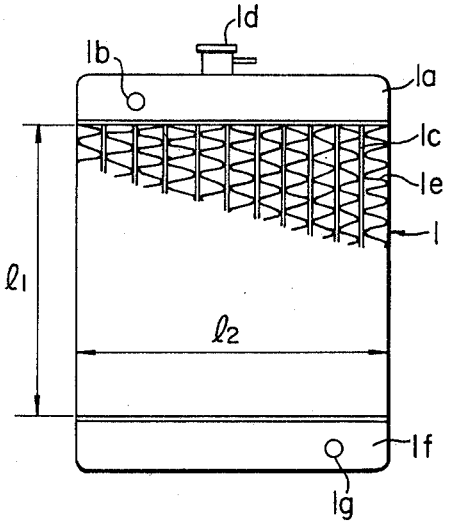
FIG. 1 is a front view of an automotive radiator embodying the heat exchanger according to the present invention.
Figure 2:
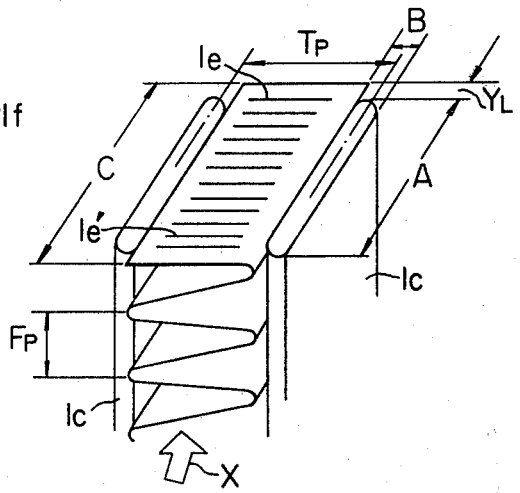
FIG. 2 is an enlarged fragmentary perspective view of a pair of tubes of the radiator and corrugated fins disposed therebetween.

Referring first to FIGS. 1 and 2, an automotive radiator generally designated by reference numeral 1 comprises an inlet tank 1*a* made of a plastic material or a metal such as brass and defining therein an inlet chamber (not shown) having an inlet port 1*b* through which the inlet chamber is adapted to be communicated with the water jacket of an internal combustion engine (not shown). The inlet chamber is also provided with a water pouring port 1*d*. The inlet tank 1*a* is mounted on the top of a radiator core which is formed of a single row of a plurality of parallel tubes 1*c* and corrugated fins 1*e* disposed between and thermally connected to each adjacent pair of the parallel tubes 1*c*. Each of the tubes 1*c* is in fluid-flow communication with the inlet chamber defined in the inlet tank 1*a*. An outlet tank 1*f* is secured to the bottom end of the radiator core and defines an outlet chamber (not shown) which is in fluid-flow communication with the bottom ends of the parallel tubes 1*c* so that the flows of the water through the tubes 1*c* are gathered into the outlet chamber and discharged through an outlet port 1*g* into the engine for recirculation therethrough. The outlet tank 1*f* is made of a material similar to that of the inlet tank 1*a*.

Each of the tubes 1*c* is made of a thin sheet of brass which is as thin as 0.13 mm, for example, and formed into substantially rectangular shape in cross-section, as shown in FIG. 2. Corrugated fins 1*e* disposed between each adjacent pair of tubes 1*c* are made of a thin strip of copper which is as thin as from 0.05 to 0.06 mm and formed into wave shape, as shown in FIG. 2. The corrugated fins 1*e* and the parallel tubes 1*c* cooperate together to define passages for air flow which is indicated by an arrow X in FIG. 2 and is caused by an air fan, not shown. The tubes 1*c* are arranged such that the longitudinal axis of the rectangular cross-section of each tube 1*c* is substantially parallel to the direction of the flow of air X through the radiator.

Figure 6:
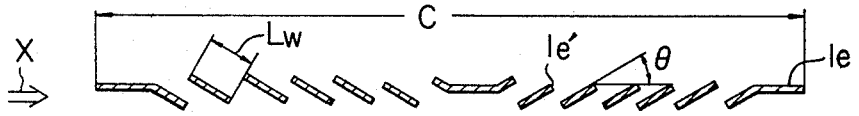
FIG. 6 is an enlarged sectional view of a fin showing louvered vanes and openings.

Each of the corrugated fins 1*e* is louvered to provide a plurality of vanes 1*e*' and a plurality of openings defined therebetween, as shown in FIG. 6. Each louver vane 1*e*' is inclined relative to the general plane of the fin 1*e* at an angle $\theta$ which is within the range of from 18° to 32°. In the illustrated embodiment of the invention, the angle of the louver vane inclination is substantially 25°.

The corrugated fins 1*e* are secured to the tubes 1*c* in the following manner: The surfaces of the tubes 1*c* are clad with a brazing material. Corrugated fins 1*e* are then assembled with the clad tubes 1*c* by means of a suitable assemblying device. The assembly is then placed in a furnace and heated therein so that the clading of the brazing material is fused to secure the corrugated fins 1*e* and the tubes 1*c* together.

The inventor has conducted extensive researches and tests in an attempt to reduce the size of such radiators as shown in FIG. 1 without reducing the radiation performance thereof. First of all, the inventor has conducted tests on various dimension C of the corrugated fins 1*e* as measured in the direction parallel to the direction of the air flow X (this dimension C will be termed hereunder as "fin width") so as to find out the effect of the reduction in the fin width C on the radiation performance of the radiator 1.

Under the condition wherein the vertical and widthwise dimensions $l_1$ and $l_2$ of the front face of the core shown in FIG. 1 are maintained unchanged ($l_1=325$ mm; $l_2=490$ mm) and the combination of the fin pitch $F_p$ and the fin width C is such that the heat radiating area of the corrugated fins 1*e* is kept constant (i.e., $C/F_p=8$), the fin width C has been gradually reduced and the radiation of fins of several widths have been measured to obtain heat conductivity of the fins per unit area of the outer surface thereof, as graphically illustrated in FIG. 3 in which the fin width of 32 mm is of the prior art radiator. Comparison between the prior art radiator fins with those tested by the inventor shows that the heat conductivity of the corrugated core is increased as the fin width C is reduced. The maximum heat conductivity was obtained when the fin width was 16 mm. The heat conductivities of the fins having the widths of from 12 to 23 mm are greater than that of the prior art fin width (32 mm) by more than 10%. Moreover, the heat conductivities at the fin widths of from 15 to 18 mm are greater than that of the prior art fin width (32 mm) by more than 15%.

Figure 3:
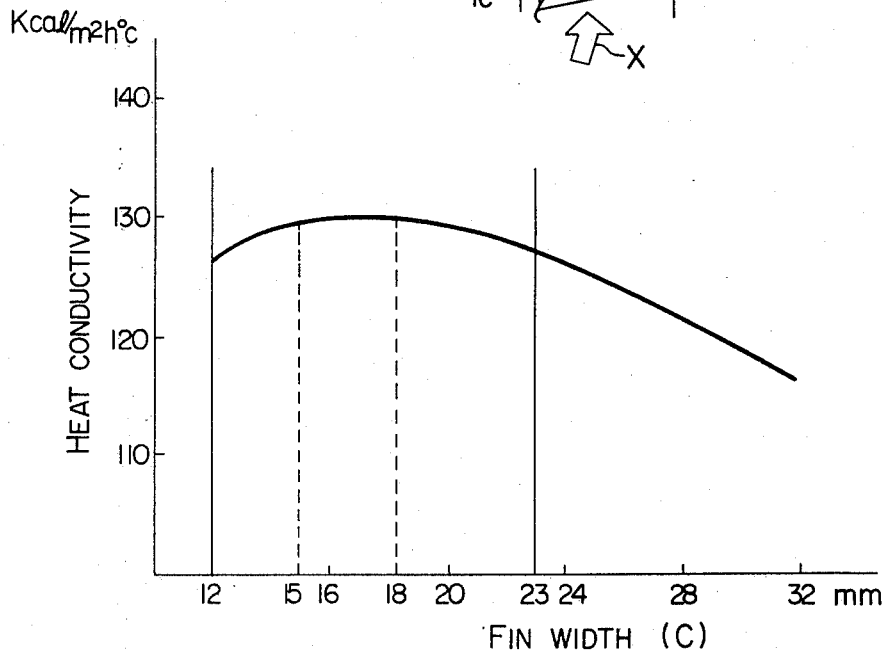
FIGS. 3 and 4 are graphs which respectively illustrate the results of tests on the width of the corrugated fins relative to the heat conductivity and on the width of the fins relative to the radiation.

In the tests, the results of which are shown in FIG. 3, the velocity of the air flow through the air passages defined in the radiator was 10 m/sec. and the engine cooling water was caused to flow through the tubes 1*c* at a rate of 40 l/min. (this water flow rate is substantially equal to the water flow rate obtained when a small-sized car equipped with about 1.6 l engine is operated at a speed of about 40 km/h.).

Figure 4:
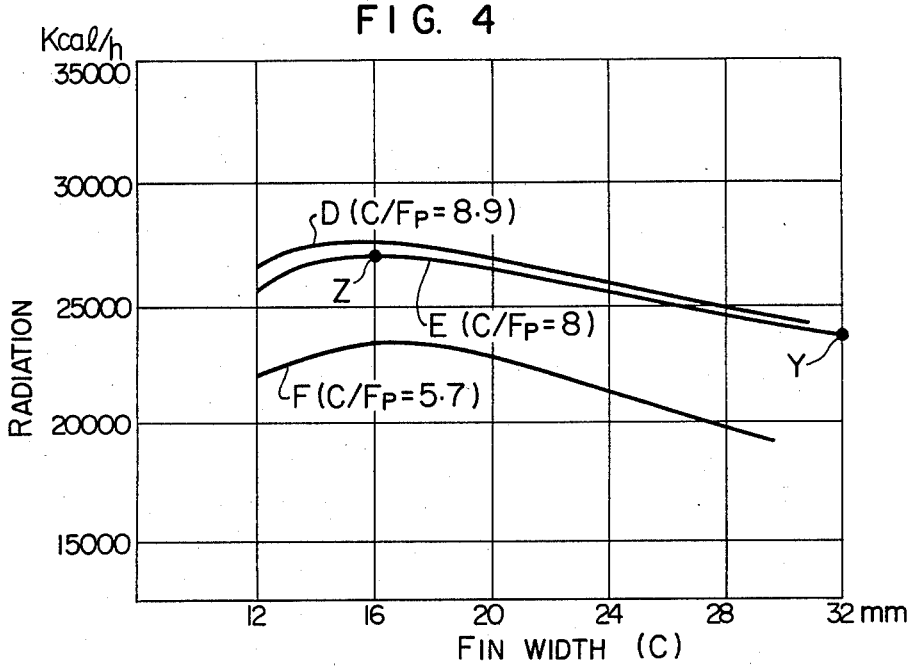

The test results shown in FIG. 3 are illustrated in FIG. 4 in terms of radiation, wherein curves D, E and F show test results obtained from three kinds of the combinations of the fin pitch $F_p$ and the fin width C, respectively; namely, curve D shows the test results in the case of $C/F_p$ being equal to 8.9, curve E shows the test results in the case of $C/F_p$ being equal to 8.0 and curve F shows the test results in the case of $C/F_p$ being equal to 5.7. As will be seen in FIG. 4, for the same heat radiating area (i.e., the ratio of $C/F_p$ is constant), the maximum radiation is at the fin width of 16 mm. The point Y in FIG. 4 shows the radiation of the prior art heat exchanger with the fin width C of 32 mm and the fin pitch $F_p$ of 4 mm. Compared with the radiation shown by the point Y, the radiation obtained from corrugated fins having fin width C of 16 mm and the ratio $C/F_p$ of 8, as shown by point Z in FIG. 4, is increased more than 10%.

Thus, it will be appreciated from the illustration in FIGS. 3 and 4 that an excellent heat exchange performance is assured by the fin widths of from 15 to 18 mm.

Figure 5:
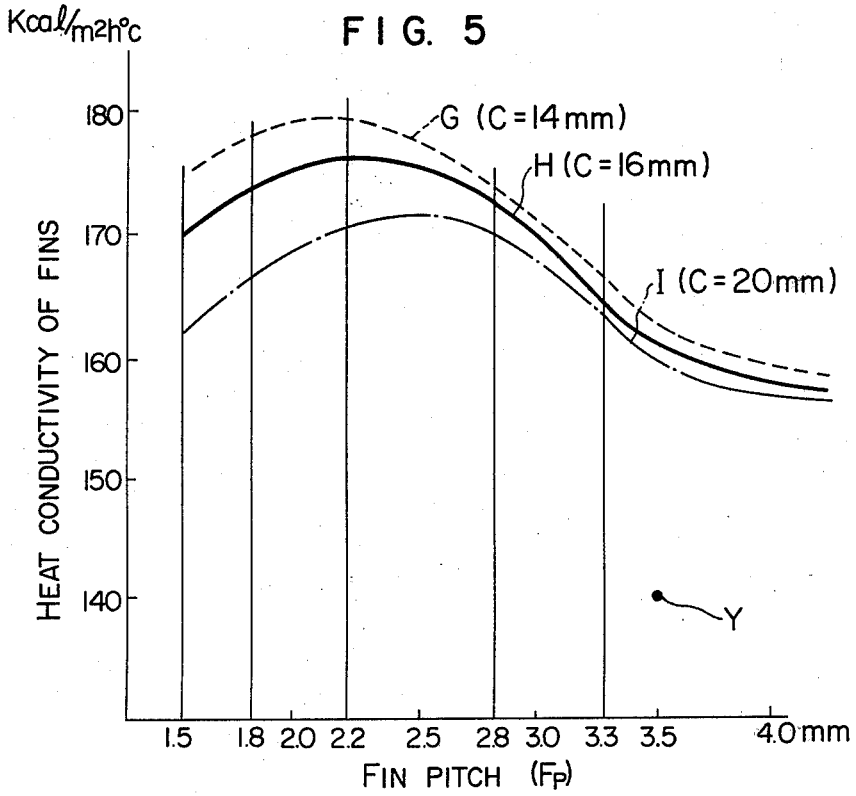
FIG. 5 is a graph illustrating the results of tests on the pitch of the corrugated fins relative to the heat conductivity of the fins.

The inventor conducted other tests on the variation in the fin pitch $F_p$ relative to the heat conductivity of the corrugated fins 1*e*. Three kinds of corrugated fins 1*e*, having widths of 14 mm, 16 mm and 20 mm, respectively, were presented for the tests and the pitches $F_p$ of the respective kinds of the corrugated fins were varied. The heat conductivities of these fins of the various kinds of pitches were measured. The results are shown in FIG. 5 wherein curves G, H and I show the results of the tests obtained from the 14 mm width fins, 16 mm width fins and 20 mm width fins, respectively. The point Y in FIG. 5 shows the heat conductivity of the prior art corrugated fins having a width C of 32 mm and a fin pitch $F_p$ of 35 mm.

It will be seen from the illustration in FIG. 5 that the heat conductivities of corrugated fins are increased as the fin width C is decreased from that of the prior art fin (shown by point Y) and also as the fin pitch $F_p$ is decreased than that of the prior art fin Y. It will be also seen in FIG. 5 that the maximum heat conductivities of the three kinds of fins 1*e* are obtained at the fin pitch of substantially 2.2 mm and that the heat conductivities of the three kinds of the corrugated fins 1*e* are greatly improved over the prior art fins Y when the fin pitches $F_p$ of the fins are limited to the range of from 1.5 to 3.3 mm and, especially, to the range of from 1.8 to 2.8. The results shown in FIG. 5 were obtained under the condition wherein the air was caused to flow through the heat exchanger at a velocity of 10 m/sec.

The inventor conducted further tests on the widths $L_w$ of louver vanes 1*e*′ (FIG. 6) relative to the heat conductivities of the fins 1*e*. Five kinds of corrugated fins, all having the same width C of 16 mm but having different pitches $F_p$ of 1.5 mm, 2.0 mm, 3.0 mm, 3.3 mm and 4.0 mm, were used in the tests and the widths of the louver vanes 1*e*′ were varied. The results of the tests are shown in FIG. 7 wherein curves J, K, L, M and N respectively illustrate the test results obtained from the corrugated fins of 1.5 mm fin pitch, 2.0 mm fin pitch, 3.0 mm fin pitch, 3.3 mm fin pitch and 4.0 mm fin pitch while a curve 0 illustrates the theoretical heat conductivity of fins which would be obtained when air flows along corrugated fins 1*e* without any separation.

Figure 7:
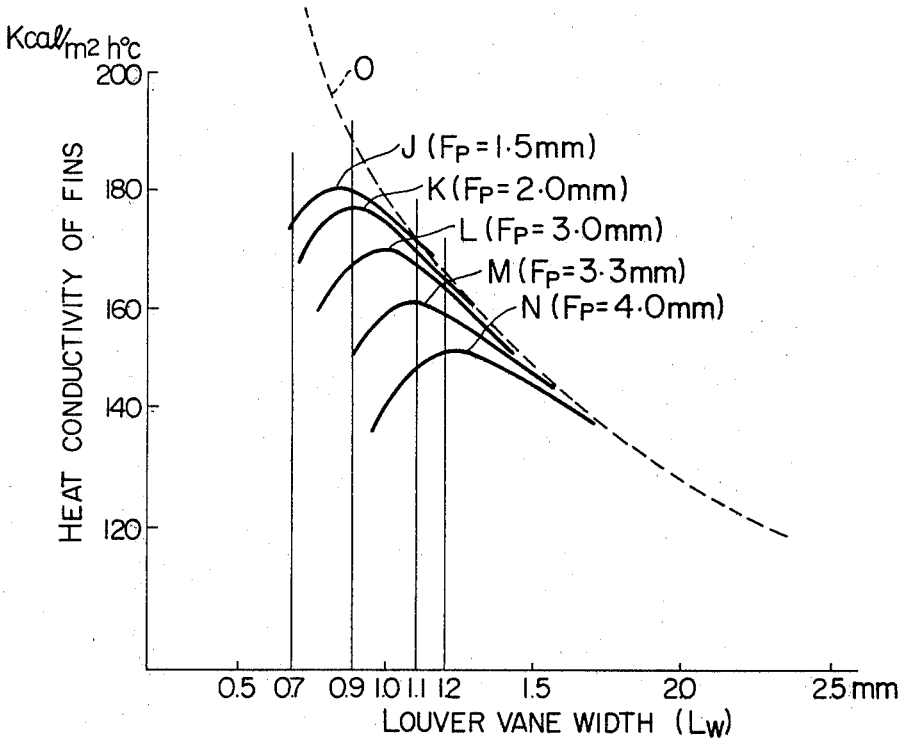
FIG. 7 graphically illustrates the results of tests on the width of the louver vanes and the heat conductivity of the fins.

It will be seen in FIG. 7 that different kinds of fin pitches $F_p$ have different louver vane widths $L_w$ at which the maximum heat conductivities of these kinds of the fins are obtained. It will be also seen that the fin heat conductivity is increased as the louver vane width $L_w$ is decreased. FIG. 7 shows that, within the fin pitches of from 1.5 to 3.3 mm, the louver vane widths of from 0.7 to 1.2 mm provide a good heat conductivity of fins and, more particularly, the louver vane widths of from 0.9 to 1.1 mm provide an excellent heat conductivity of the fins.

The test results shown in FIG. 7 were obtained under the conditions wherein the velocity of the air flow through the heat exchanger was substantially at 10 m/sec. and the angles of inclination $\theta$ of the louver vanes 1*e*′ relative to the general planes of associated fins 1*e* were within the range of from 24° to 28°. The reason why the range of from 18° to 32° is used as the angles of inclination $\theta$ of the louver vanes 13′ is because, if the angle of inclination $\theta$ is too small, the laminar boundary layers on the louver surfaces will be so thick that high heat conductivities of the fins will not be obtained and, if the angle of inclination $\theta$ is too large, there will be produced separation of the air flow at the louver vanes with a resultant increase in the pressure loss of the air flow and decrease in the heat exchange performance of the heat exchanger. In addition, a too large angle of inclination $\theta$ is impractical from the view point of workability.

Figure 8:
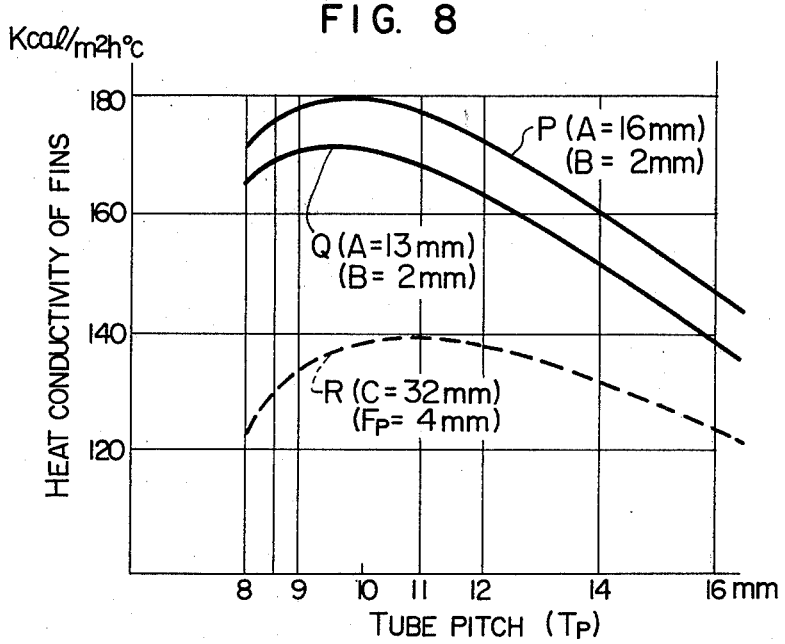
FIG. 8 graphically illustrates the results of tests on the pitch of the tubes relative to the heat conductivity of the fins.

The inventor conducted still further tests on tubes 1*c* suitable for the fins 1*e*. The results of these are shown in FIGS. 8 through 11. FIG. 8 illustrates the results of tests of tubes 1*c* having different widths A (FIG. 2) concerning tube pitches $T_p$ and heat conductivities of the corrugated fins. Curve P in FIG. 8 illustrates the test results obtained from the combination of tubes and fins wherein the tubes each had a width A of 16 mm and thickness B of 2 mm, whereas curve Q illustrates the test results from the combination of tubes and fins wherein the tubes each had a width A of 13 mm and the thickness B of 2 mm. The fins used in both cases had the same width C of 16 mm, the same louver vane width of 1 mm and the angles of the louver vane inclination of the same range of from 24° to 28°. The tubes 1*c* were arranged in a single row in each test. The tube pitches $T_p$ were varied from one test to another and the heat conductivities were measured. Curve R in FIG. 8 shows the test results obtained from the combination of parallel tubes 1*c* arranged in two rows and conventional corrugated fins having fin width C of 32 mm and fin pitch $F_p$ of 4 mm. The test results shown in FIG. 8 were obtained under the condition in which the velocity of the air flow through the heat exchanger was 8 m/sec.

It will be seen in FIG. 8 that, with the fins 1*e* having the fin width C of 16 mm, the maximum heat conductivities of the fins were obtained when the tubes were arranged at the pitch of substantially 10 mm and that higher fin heat conductivities were obtained from the use of tubes having the larger tube width A (curve P). In addition, it has been found that the use of the fins 1*e* according to the present invention provides fin heat conductivies which are much higher than those obtained from the use of the conventional corrugated fins.

Figure 9:
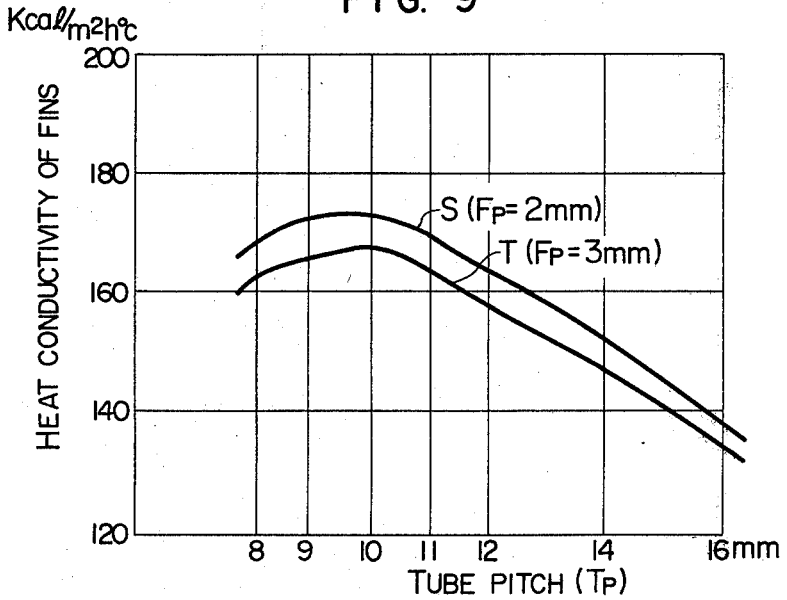
FIG. 9 graphically illustrates the results of tests on the pitch of the tubes relative to the heat conductivity of the fins with different fin pitches.
Figure 10:
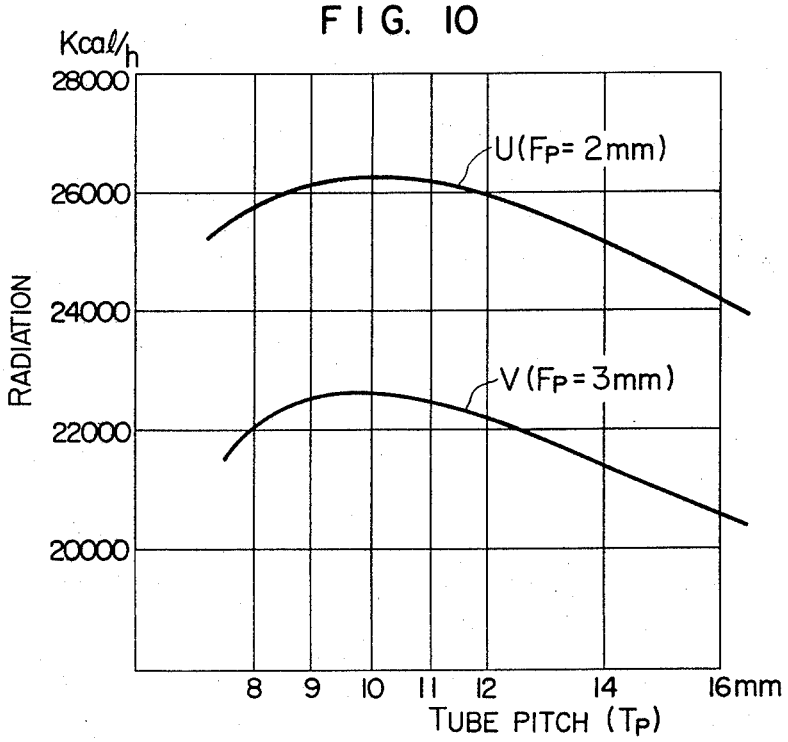
FIG. 10 graphically illustrates the results of tests on the pitch of the tubes relative to the radiation.

The inventor conducted still further tests on the tube pitches $T_p$ relative to the heat exchange performance. FIG. 9 illustrates the results of tests on tube pitches $T_p$ relative to the heat conductivities of the fins while FIG. 10 shows the results of tests on the tube pitches $T_p$ relative to the radiation. Curves S and T in FIG. 9 show the test results from the fin pitches $F_p$ of 2 mm and 3 mm, respectively, whereas curves U and V in FIG. 10 show the test results from the fin pitches $F_p$ of 2 mm and 3 mm, respectively. It will be seen in FIGS. 9 and 10 that the maximum heat exchange performance were obtained when the tubes were arranged at the tube pitch of 10 mm.

The optimum range of the width A of tubes 1*c* suited for the fins 1*e* is to be decided on the bases of the heat conductive characteristics of the inner sides of the tubes 1*c* and the heat radiation performances of the outer sides of the fins which are thermally connected to the tubes 1*c*. Thus, the inventor conducted further tests on the heat radiation performances of fins relative to various differences between the tube width A and the fin width C. The results of the tests are shown in FIG. 11 wherein the differences between the tube width A and the fin width C is represented by "Fin Extension" $Y_L$ which is given by:

$$Y_L = \tfrac{1}{2}(C-A)$$

Figure 11:
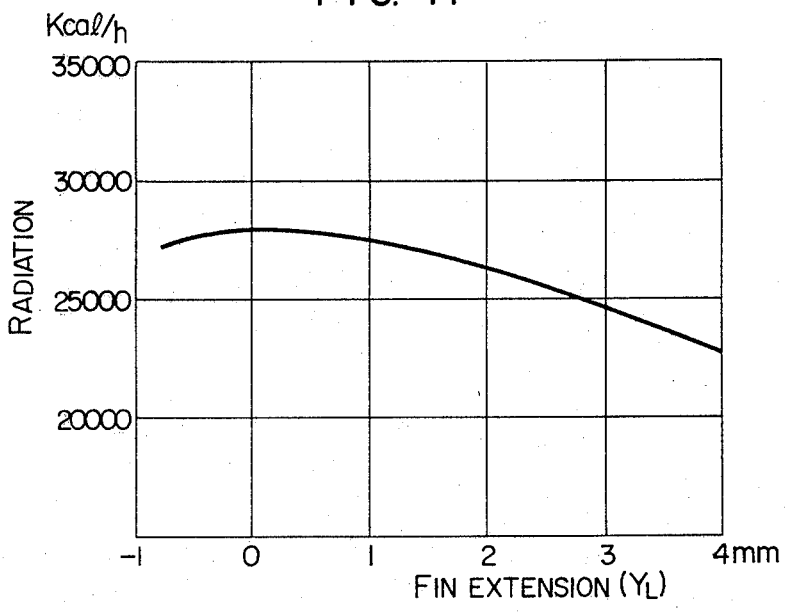
FIG. 11 graphically illustrates the results of tests on the extension of the fins beyond the tube width relative to the radiation.

It will be seen in FIG. 11 that the radiation is low in the range where the tube widths A are less than the fin widths C because, in this range, the heat is not well transferred from the tubes to the fins and that the radiation is also low in the range where the tube widths A are greater than the fin widths C because, in this range, the tubes have increased internal cross-sectional areas with a resultant decrease in the velocity of the water flow through the tubes and thus decrease in the heat conductivities and heat radiation. Accordingly, the dimension of the longitudinal axis of the rectangular cross-section of each tube, i.e., the tube width A, should preferably be not greater than the dimension C of each fin as measured in the direction of the flow of air through the heat exchanger. More specifically, the fin extension $Y_L$ should be within the range of from 0 (zero) to 2 mm.

The test results shown in FIG. 11 were obtained under the condition where the velocity of the air flow through the heat exchanger was about 8 m/sec. and the tubes each had a thickness B of 2 mm.

It will be seen in FIGS. 8 to 11 that an optimum heat radiation will be obtained from the arrangement of the tubes 1*c* at the pitch of from 8.5 to 11 mm and, more preferably, from 9 to 11 mm irrespective of variations in the tube width A and also in the fin pitch $F_p$ and that the combination of the fins 1*e* and the tubes 1*c* having the tube width A of not greater than the fin width C and, more specifically, the use of the fins and tubes which are dimensioned such that the fin extensions $Y_L$ beyond the lateral sides of associated tubes are within the range of from 0 (zero) to 2 mm, provides a heat exchanger which provides a heat exchange performance higher than that obtainable from the conventional corrugated fin type heat exchanger.

As described above, the corrugated fins 1*e* used in the present invention are of widths C of from 12 to 23 mm. The use of the tubes 1*c* having widths A of not greater than the fin widths C inevitably results in a decrease in the water-flow cross-sectional areas of the tubes. Thus, the inventor conducted experiments and researches on the flow circuits of a fluid to be cooled by the heat exchanger and also on the shapes of the tubes 1*c*.

Figure 12:
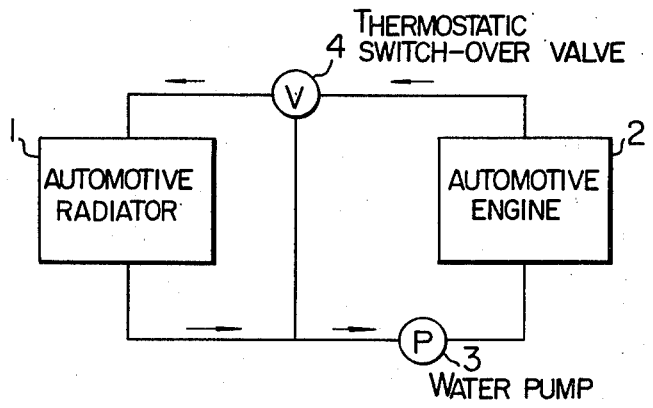
FIG. 12 is a block diagram showing an engine cooling system utilizing the radiator shown in FIG. 1.

FIG. 12 is a diagrammatic illustration of an engine cooling system in which the heat exchanger according to the present invention is utilized as a radiator 1. The system includes a water pump 3 driven by an engine 2 to positively recirculate the engine cooling water. The speed of the pump 3 will be varied with the speed of the engine 2 so that, when the engine is operated at a high speed, the cooling water is recirculated at a rate high enough to assure the necessary heat exchange performance of the radiator 1. A thermostatic switch-over valve 4 is provided in the engine cooling system to ensure that, when the water temperature is lower than a predetermined temperature (80° C., for example), the water is recirculated bypassing the radiator 1 to prevent the water from being unduly cooled and that, when the water temperature exceeds the predetermined temperature, the water is recirculated through the radiator 1.

Figure 13:
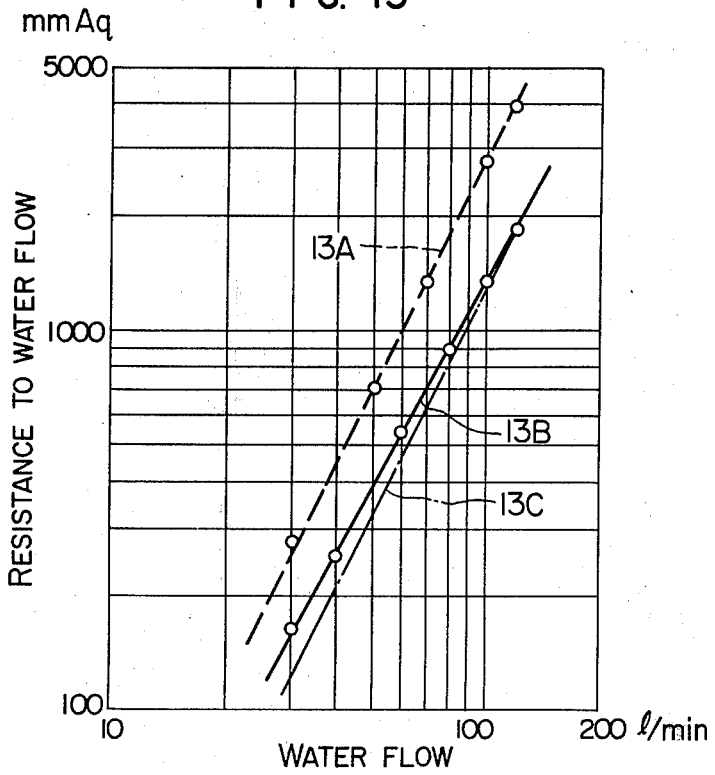
FIG. 13 graphically illustrates the results of tests of the engine cooling system concerning the water flows through the components of the system and the resistance of the components to the water flows therethrough.

The resistances, to the water flow, of the radiator 1, of the engine 2 and of the valve 4 were measured, the results of the measurements being shown in FIG. 13 wherein curves 13A, 13B and 13C show the water-flow resistances of the engine 2, the radiator 1 and the valve 4. It will be seen in FIG. 13 that the water-flow resistances of the radiator 1 and the valve 4 are substantially equal and the water-flow resistance of the engine 2 is as high as substantially two times of the water-flow resistances of the radiator 1 and the valve 4. In the engine cooling system shown in FIG. 12, therefore, the water-flow resistances of the radiator 1, of the engine 2 and of the thermostatic change-over valve 4 are substantially at the ratio of 25%, 50% and 25%, respectively. In other words, the water-flow resistance of the radiator 1 is as low as ¼ of the total water-flow resistance of the engine cooling system shown in FIG. 12. For this reason, the inventor confirmed that the influence of the increase in the water-flow resistance of the radiator 1 on the recirculation rate of the engine cooling water through the system is fairly minor.

The inventor further conducted experimental tests on the increase in the water-flow resistance of the radiator 1 relative to the decrease in the radiation performance of the radiator. The results are shown by a curve 14A in FIG. 14, from which it will be appreciated that the increase in the water-flow restance of the radiator 1 to a value which is equal to 5 times of the initial value resulted in only 2% of decrease in the radiation performance of the radiator. This will mean that the increase in the water-flow resistance of the radiator 1 does not produce any practical problem. This is considered to be for the following reasons:

As the cross-sectional areas of the water-flowing passages defined in the tubes 1*c* of the radiator are decreased, the velocity of the water flows through the tubes is increased with resultant turbulences produced in respective tubes. Under turbulent condition, the heat transfer per unit area of the inner surface of each tube 1*c* increases in proportion to 0.8 power of the velocity of the water flow through the tube. Thus, if the water flow velocity is increased by two times, the heat transfer will be increased by 1.74 times. Accordingly it is considered that the increase in the heat transfer per unti area of the inner surface of each tube 1*c* is effective to compensate for the decrease in the tube inner surface which in turn is due to the decrease in the cross-sectional area of the tube.

Figure 14:
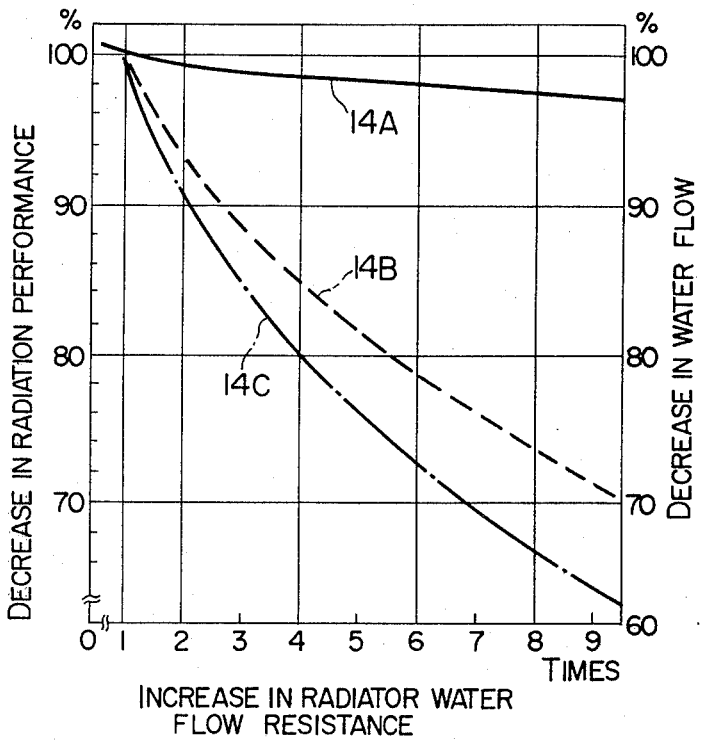
FIG. 14 graphically illustrates the results of tests on the increase in the water flow resistance of the radiator relative to the decrease in the radiation performance and to the decrease in the water flow.

Lines 14B and 14C in FIG. 14 respectively represent the increase in the water flow resistance of the radiator 1 relative to the decrease in the water flow through the engine 2, and the increase in the water flow resistance of the radiator relative to the decrease in the water flow through the radiator. The curves 14B and 14C show that, when the water flow resistance of the radiator 1 is increased to a value which is equal to five times of the initial value, the water flow through the engine 2 is decreased substantially by 18% and the water flow through the radiator 1 is decreased substantially by 24%. However, it has already been ascertained that, in the engine cooling system of such a type as shown in FIG. 12, the decrease in the water flow through the engine 2 by about 20% does not practically cause any thermal trouble on the engine 2. Thus, a five time increase in the water flow resistance of the radiator 1 does not produce any practical problem. In the engine cooling system shown in FIG. 12, therefore, a substantial increase in the water flow resistance of the radiator 1 does not adversely affect the heat radiation performance of the radiator 1 and the engine cooling capacity. Stated in other words, the test results shown in FIGS. 13 and 14 indicate that the decrease in the widths C of the corrugated fins 1*e* and the simultaneous decrease in the water-flow cross-sectional areas of the tubes 1*c* do not cause any practical problem in the heat radiation performance of the radiator 1.

The test results shown in FIG. 14 were obtained under the conditions where the engine speed was 5,000 r.p.m. and the engine cooling water was at about 80° C.

The width C of the corrugated fins 1*e* employed by the inventor is greatly decreased than the fin width employed in the conventional radiator. Thus, if the parallel tubes 1*c* were arranged in two or three rows in the direction of the air flow X through the radiator as in the prior art radiator, the dimensions or sizes of the tubes 1*c* would have to be greatly decreased. The decrease in the tube size, however, is not desirable in the view point of the manufacture of the radiator 1. For this reason, the tubes of the radiator according to the present invention are arranged in a single row.

Figure 15:
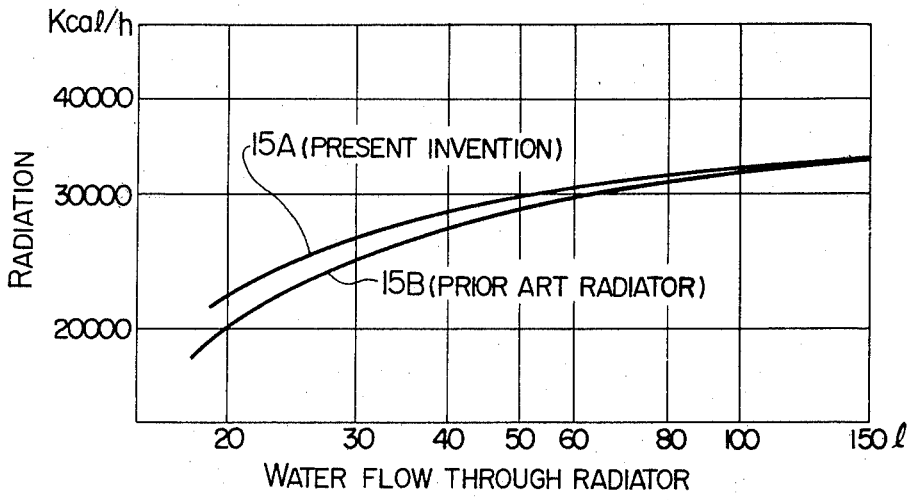
FIG. 15 graphically illustrates the results of tests of the applicant's heat exchanger and the prior art heat exchanger concerning the water low therethrough relative to the radiation.

FIG. 15 shows results of tests which the inventor conducted to examine the heat radiation performances of the radiator according to the present invention and of the prior art radiator. Curves 15A and 15B in FIG. 15 illustrate the test results from the inventor's radiator and the prior art radiator, respectively. In the inventor's radiator, the width C of the corrugated fins 1*e* was 16 mm; the fin pitch $F_p$ was 2.0 mm; the width $L_w$ of the louver fins was 1.0 mm; the angles of inclination $\theta$ of the louver vanes 1*e'* were within the range of from 26° to 28°; the width A of the tubes 1*c* was 13 mm; the tubes 1*c* were arranged in a single row at the tube pitch $T_p$ of 10 mm; and the ratio of the tube pitch $T_p$ to the fin width C, i.e., $T_p/C$, was 0.62. On the other hand, the prior art radiator had dimensions and arrangement as follows: The width C of corrugated fins was 32 mm; the fin pitch $F_p$ was 3.5 mm; the louver vane width $L_w$ was 1.4 mm; the angles of inclination $\theta$ of the louver vanes were within the range of from 26° to 28° ; the tube width A was 13 mm; the tube pitch $T_p$ was 12 mm; and the tubes were arranged in two rows in the direction of the air flow (see the arrow X in FIG. 2). The tested prior art radiator is substantially identical with those conventionally used with motor cars. The two radiators thus tested had radiator cores of the same dimensions; namely, the vertical dimension $l_1$ was 325 mm and the widthwise dimension $l_2$ was 490 mm in both radiators. The air flows through the radiators were at the velocity of 10 m/sec. in both tests.

It will be seen in FIG. 15 that, within all the water flow range of from 0 (zero) to 100 l/min., namely, within all the operating range of a small-sized motor car equipped with an engine of the order of about 1.6 l displacement, the inventor's radiator provides a heat radiation performance which is superior to that of the prior art radiator. Especially, it will be noted that the heat radiation performance of the inventor's radiator is greatly improved over that of the prior art radiator during engine idle operation (i.e., at the water flow rate of as low as about 30 l/min).

As described above, the inventor's radiator is small-sized and light-weighted but provides a high heat exchange performance.

The heat exchanger according to the present invention has been described as being utilized as an automotive radiator. The use of the heat exchanger according to the present invention, however, is not limited to the automotive radiator. For example, the heat exchanger may be used as a heater core of an automotive air conditioner or as a radiator of a domestic air conditioner. Thus, the fluid to be recirculated through the tubes of the heat exchanger is not limited to engine cooling water.

What is claimed is:

1. A corrugated fin type heat exchanger comprising a plurality of equally spaced parallel tubes arranged in a single row and defining therein a first series of passages for a first fluid and a corrugated strip defining fins disposed between and thermally connected to each pair of adjacent tubes to cooperate therewith to define a second series of passages for a second fluid, each of said tubes being of the same substantially rectangular cross-section and arranged such that the longitudinal axis of said rectangular cross-section is substantially parallel to the direction of the flow of the second fluid passing through said second series of passages, means defining an inlet chamber for the first fluid operative to distribute the first fluid to said tubes, and means defining an outlet chamber operative to gather flows of the first fluid from said tubes, characterized by:

the dimension of each of said fins as measured in the direction of the flow of the second fluid is within the range of from 12 mm to 23 mm;

the pitch of the corrugations of said corrugated strip defining said fins is within the range of from 1.5 mm to 3.3 mm;

said fins are louvered to provide vanes and openings, said vanes of each fin being arranged in at least two successive groups in the direction of the flow of the second fluid with the vanes in each group being inclined with respect to the general plane of the corresponding fin at an angle opposite to that of the vanes of adjacent groups;

the width of each vane is within the range of from 0.7 mm to 1.2 mm; and each vane is inclined at an angle of from 18° to 32°.

2. A heat exchanger according to claim 1 in which the dimension of each of said fins as measured in the direction of the flow of the second fluid is within the range of from 15 mm to 18 mm.

3. A heat exchanger according to claim 1 or 2 in which the pitch of the corrugations of the corrugated strip is within the range of from 1.8 mm to 2.8 mm.

4. A heat exchanger according to claim 1 or 2 in which the width of each vane is within the range of from 0.9 mm to 1.1 mm.

5. A heat exchanger according to claim 1 or 2 wherein:

the width of each vane is within the range of from 0.9 mm to 1.1 mm; and each vane is inclined at an angle of about 25°.

6. A corrugated fin type heat exchanger comprising a plurality of equally spaced parallel tubes arranged in a single row and defining therein a first series of passages for a first fluid and a corrugated strip defining fins disposed between and thermally connected to each pair of adjacent tubes to cooperate therewith to define a second series of passages for a second fluid, each of said tubes being of the same substantially rectangular cross-section and arranged such that the longitudinal axis of said rectangular cross-section is substantially parallel to the direction of the flow of the second fluid passing through said second series of passages, means defining an inlet chamber for the first fluid operative to distribute the first fluid to said tubes, and means defining an outlet chamber operative to gather flows of the first fluid from said tubes, characterized by:

the dimension of each of said fins as measured in the direction of the flow of the second fluid is within the range of from 12 mm to 23 mm;

the pitch of the corrugations of said corrugated strip defining said fins is within the range of from 1.5 mm to 3.3 mm;

the dimension of the longitudinal axis of the rectangular cross-section of each said tube is within the range of 8 mm to 23 mm but not greater than the dimension of each said fin as measured in the direction of the flow of the second fluid;

the pitch of said tubes is within the range of from 8.5 mm to 14 mm;

said fins are louvered to provide vanes and openings, said vanes of each fin being arranged in at least two successive groups in the direction of the flow of the second fluid with the vanes in each group being inclined with respect to the general plane of the corresponding fin at an angle opposite to that of the vanes of adjacent groups;

the width of each vane is within the range of from 0.7 mm to 1.2 mm; and each vane is inclined at an angle of from 18° to 32°.

7. A heat exchanger according to claim 6, wherein the dimension of each fin as measured in the direction of the flow of the second fluid is within the range from 15 mm to 18 mm.

8. A heat exchanger according to claim 6 or 7, wherein the pitch of the corrugations of the corrugated strip defining the fins is within the range of from 1.8 mm to 2.8 mm.

9. The heat exchanger defined in claim 8 in which the dimension of the transverse axis of the rectangular cross-section of each tube is about 2 mm.

10. A heat exchanger according to claim 6 or 7 wherein the pitch of the tubes is within the range of from 9 mm to 11 mm.

11. The heat exchanger defined in claim 10 in which the dimension of the transverse axis of the rectangular cross-section of each tube is about 2 mm.

12. A heat exchanger according to claim 6 or 7 wherein the width of each vane is within the range of from 0.9 mm to 1.1 mm.

13. The heat exchanger defined in claim 12 in which the dimension of the transverse axis of the rectangular cross-section of each tube is about 2 mm.

14. A heat exchanger according to claim 6 or 7 wherein the angle of inclination of each vane is about 25°.

15. The heat exchanger defined in claim 14 in which the dimension of the transverse axis of the rectangular cross-section of each tube is about 2 mm.

16. A heat exchanger according to claim 6 or 7 wherein the fins extend beyond the opposite ends of the rectangular cross-section of the corresponding tube pair a distance not over 2 mm.

17. The heat exchanger defined in claim 16 in which the dimension of the transverse axis of the rectangular cross-section of each tube is about 2 mm.

18. The heat exchanger defined in claim 6 or 7 in which the dimension of the transverse axis of the rectangular cross-section of each tube is about 2 mm.

19. A heat exchanger according to claim 6 wherein:

the dimension of each fin as measured in the direction of the flow of the second fluid is within the range of from 15 mm to 18 mm;

the pitch of the corrugations of the corrugated strip defining the fins is within the range of from 1.8 mm to 2.8 mm; and the pitch of the tubes is within the range of from 9 mm to 11 mm.

20. The heat exchanger defined in claim 19 in which the dimension of the transverse axis of the rectangular cross-section of each tube is about 2 mm.

21. A heat exchanger according to claim 19 wherein: the width of each vane is within the range of from 0.9 mm to 1.1 mm.

22. A heat exchanger according to claim 19 or 21 wherein the angle of inclination of each vane is about 25°.

23. The heat exchanger defined in claim 21 in which the dimension of the transverse axis of the rectangular cross-section of each tube is about 2 mm.

* * * * *